United States Patent [19]

Kissell

[11] 3,977,312

[45] Aug. 31, 1976

[54] PARACHUTE STOPPING FOR MINE VENTILATION USE

[75] Inventor: Fred N. Kissell, Pittsburgh, Pa.

[73] Assignee: The United States of America as represented by the Secretary of the Interior, Washington, D.C.

[22] Filed: Oct. 31, 1975

[21] Appl. No.: 627,811

[52] U.S. Cl. ..... 98/50; 61/45 R; 299/12; 299/19; 169/64; 244/142

[51] Int. Cl.[2] ..... E21F 17/00; E21F 1/14

[58] Field of Search ..... 98/50; 61/45 R, 42; 299/12, 19; 169/64, 45, 48; 244/142

[56] References Cited

UNITED STATES PATENTS

| | | | |
|---|---|---|---|
| 2,947,239 | 8/1960 | Burgess | 98/50 |
| 3,006,267 | 10/1961 | Hangis | 98/50 |
| 3,948,057 | 4/1976 | Hill | 98/50 |

FOREIGN PATENTS OR APPLICATIONS

| | | | |
|---|---|---|---|
| 1,339,414 | 12/1973 | United Kingdom | 244/142 |

*Primary Examiner*—William E. Wayner
*Assistant Examiner*—Henry C. Yuen
*Attorney, Agent, or Firm*—Thomas Zack; Donald R. Fraser

[57] ABSTRACT

A parachute-type mine stopping used in ventilation control comprises a parachute-like canopy suspended from straps or lines secured to a roof bolt or the like. After the lines are so secured, the stopping is erected by merely lifting the upper edge of the canopy into the airstream in the passage, the airstream causing the canopy to simply "pop" into place. In a preferred embodiment, a skirt is sewn to the peripheral edge of the canopy to improve sealing.

7 Claims, 3 Drawing Figures

PARACHUTE STOPPING FOR MINE VENTILATION USE

FIELD OF THE INVENTION

The present invention relates to ventilation control systems for mines and, more particularly, to a quick-erect parachute-type mine stopping.

BACKGROUND OF THE INVENTION

Characteristically, mines include a plurality of parallel entries extending from the mine opening to the face of the mine, wherein at least one of the entries serves as ventilation path through which air is furnished to the face of the mine. As the mine is dug deeper, crosscuts are provided at regularly spaced intervals. It will be appreciatd as the mine proceeds inwardly these crosscuts must be blocked to ensure that fresh air is continuously supplied to the mine face and so-called "stoppings" are used for this purpose. Although permanent or semi-permanent stoppings are generally used in practice, in many mines, such as metal mines, temporary changes are made in the ventilation on a day-to-day basis. It would be appreciated that permanent, and even semi-permanent, stoppings are obviously not suitable for this purpose because of the expense thereof and the installation time required.

Another use of mine stoppings, and one which is of importance here, is in mine disasters, such as mine fires, in shutting off or blocking a passage so as to re-establish or re-route ventilation as required. Again, stoppings used for this purpose must be established rapidly and many conventional stoppings simply cannot be used.

There are a number of patents which deal with stoppings used in mine ventilation control and reference is made to U.S. Pat. Nos. 1,478,303 (Snyder); 2,947,239 (Burgess); 3,118,363 (Burgess, Jr.) and 3,863,554 (Boyd) for a further discussion of the problems involved as well as the solutions that have been provided. Briefly considering these patents, the Snyder patent discloses a mine air stop in the form of a rigid frame having a textile covering thereon and including relief door hinged to the frame. The Burgess patent discloses ventilation control system in the form of a flexible sheet supported from the roof timbers and held down at the bottom by a weights (such as pieces of rock or coal). The Burgess, Jr. patent discloses a similar mine ventilation system wherein a mine ventilation sheet is supported by telescoping poles which extend between the floor and roof of the mine opening. The Boyd patent discloses a portable mine stopping wherein a sheet of fire resistant, gas impervious sheet is supported on a frame. Channel-like straps are adapted to compress edge portions of the sheet in sealing relationship with the walls of the mine opening (crosscut). In one embodiment of this patent the sheet is permitted to balloon out.

SUMMARY OF THE INVENTION

In accordance with the invention, an improved, parachute-type stopping is provided which affords substantial advantages regarding installation time as compared with prior art stoppings, yet provides highly effective blockage or stopping performance. The stopping of the invention may be erected in a matter of minutes, as compared with hours for many conventional stoppings or bulkheads, thus providing tremendous savings in time and labor. Moreover, the stopping of the invention is extremely easy and inexpensive to manufacture in relationship to prior art devices of this type.

According to a preferred embodiment thereof, the mine stopping of the invention comprises a parachute-type canopy, fabricated of an air impermeable material, a plurality of support lines connected at one end thereof to the canopy, and securing means connected to the other ends of the support lines for affixing the canopy to an anchor point within the mine passage in which the stopping is used. To erect the stopping, the affixing means is attached to any secure projection within the mine passage, such as a roof bolthead and the parachute canopy rolled out downwind. The upper edge of the canopy is physically lifted into the wind, i.e., the passage airstream, and the parachute canopy then simply "pops" into place so as to block the airflow.

In a preferred embodiment, the canopy includes a skirt which is secured to the periphery of the canopy and extends outwardly therefrom to aid in sealing. The parachute canopy may be of a conventional oval or hemispherical shape or may be conical or funnel shaped, or of any other suitable configuration.

Other features and advantages of the invention will be set forth, in or apparent from, the detailed description of the preferred embodiments found hereinbelow.

DESCRIPTION OF THE PREFERRED EMBODIMENTS

Figure 1:
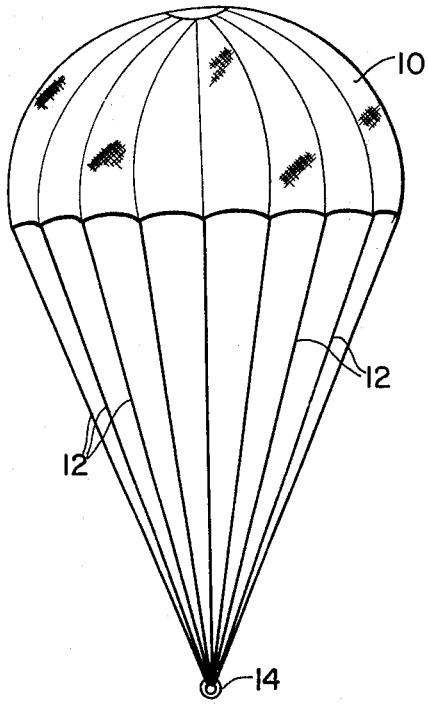
FIG. 1 is a side elevational view of a first embodiment of parachute stopping in accordance with the invention.

Referring to FIG. 1, a parachute stopping constructed in accordance with one embodiment of the invention is shown. The stopping includes a hemispherical parachute canopy 10 which is similar to those used with conventional parachutes and is fabricated of an air impermeable cloth. In a specific embodiment the cloth used is a laminated compound of 0.75-mil Mylar and 5.5oz/yd$^2$ nylon fabric. A series of straps or lines 12 are connected at one end to canopy 10 at spaced locations around the periphery of the canopy and are connected at the other to a common attachment device 14, shown here in the form of a simple attachment ring. In the specific embodiment referred to, with a canopy diameter of 12 feet, 12 nylon straps or cords 12 are used, each 1-inch wide by 20-feet long.

Figure 2:
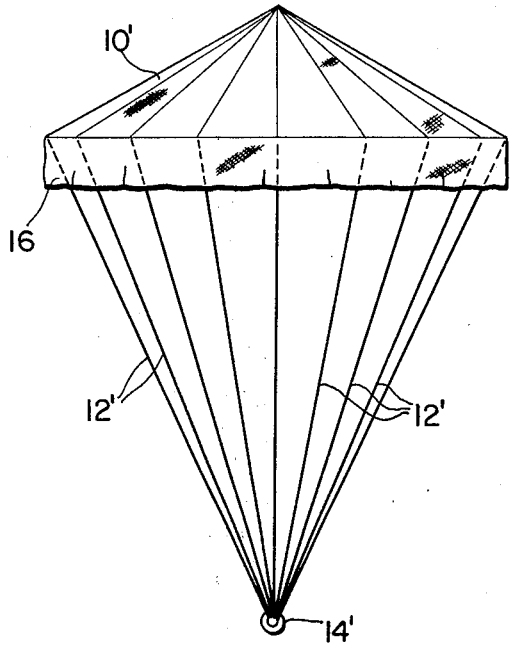
FIG. 2 is a side elevational view of a parachute stopping in accordance with a second embodiment of the invention.

A second embodiment of the invention is shown in FIG. 2. This embodiment is similar to that of FIG. 1 and similar elements have been given the same numbers with primes attached. The only differences between the two embodiments are that, in the embodiment of FIG. 2, the canopy 10' is shaped as a broad based funnel or cone, and a skirt 16 is added to the peripheral edge of the canopy. The skirt 16 is secured, such as by sewing, to the canopy edge and, as illustrated, hangs downwardly (extends outwardly) therefrom. The shape of the canopy, together with an increase in the canopy diameter, is used to decrease the size of the channels or passageways produced where the load straps 12' peel the sealing edge away from the mine passage wall. The skirt 16 further serves to seal off these channels and has proved to provide an excellent seal.

Figure 3:
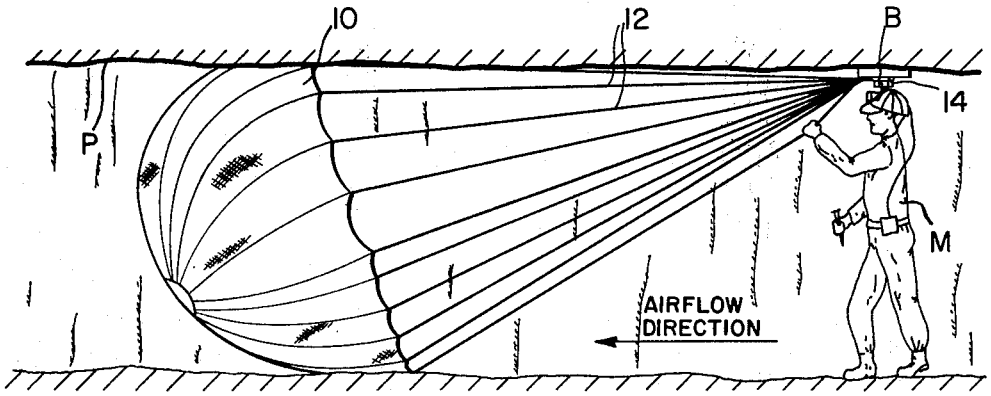
FIG. 3 is a side elevational view of a mine passage in which the parachute stopping of the invention is incorporated, depicting the parachute stopping in place, i.e., in the erected or operative state.

Referring to FIG. 3, the parachute stopping of FIG. 1 is shown in use. The stopping 10 is erected or installed by first securing the straps 12, by means of ring 14, to a fixed point within the mine passage P and preferably to the passage roof. In the example shown, straps 12 are secured to a roof bolt B. The top edge of the canopy fabric is then lifted into the airstream and the canopy 10 simply pops into place as shown. In specific testing, the time taken by the canopy to "pop" into place has been found to be approximately 1 second. It has also been found that the canopy does a fair job of aligning itself under these circumstances, although adjustments are preferably made to provide the best seal. In the specific testing referred to, the total set-up time was less than 10 minutes.

In two tests conducted with a parachute stopping of the type shown in FIG. 2, it was found that leakage was 3,000 cfm and 1,250 cfm, respectively, through tiny cracks behind pipes and similar hard to seal areas. The differential pressure across the stopping was 1.45 inches wg. The perimeter of the canopy should, of course, be greater than that of the passage to be blocked, and according to a rough rule of thumb, the perimeter of the canopy should be approximately 150% greater than that of the passage.

Although a mine passage of a special shape or characteristic, such as a drift mine which is heavily timbered with post or logging, is not easy to seal using the stopping of the invention, and although the stopping of the invention requires some minimum air velocity for inflation and a minimum static differential pressure for maintenance, the stopping does, in many applications, provide blocking comparable to that of the conventional stopping and possesses obvious advantages regarding cost and speed of installation. As noted above, the invention had particular advantages insofar as mine safety is concerned, in that, for example, the stopping of the invention can be very rapidly erected under emergency conditions, such as mine fires, to reestablish or re-route the ventilation paths in a mine.

Although the present invention has been described relative to exemplary embodiments thereof, it will be appreciated by those skilled in the art that variations and modifications may be effected in these embodiments without departing from the scope and spirit of the invention.

I claim:

1. A mine stopping for controlling air ventilation in a mine passage, said stopping comprising a parachute-type substantially air impermeable canopy, constructed of an air impermeable material, for, when erected, blocking the mine passage in which the canopy is located, a plurality of lines secured at one end thereof at spaced locations near the peripheral edge of the canopy, and means, connected to said lines at the other ends thereof, for securing said lines to a fixed point within the passage in which the canopy is located.

2. A mine stopping as claimed in claim 1 further comprising a skirt attached along one edge to the peripheral edge of said canopy and extending outwardly from said canopy.

3. A mine stopping as claimed in claim 1 wherein said canopy is hemispherical in shape.

4. A mine stopping as claimed in claim 1 wherein said canopy is conical in shape.

5. A mine stopping as claimed in claim 2 wherein said canopy is conical in shape.

6. A mine stopping as claimed in claim 1 wherein the perimeter of the canopy is approximately 150% of that of the perimeter of the passage.

7. A method of stopping a mine passage to control mine ventilation using a parachute-type stopping comprising a substantially air impermeable parachute canopy and a plurality of lines connected thereto, said method comprising arranging the parachute canopy underside faces in the direction of the airflow in the passage, securing the ends of the lines connected to the parachute canopy to a fixed point on the passage wall, and raising the parachute canopy when the canopy is filled by the air flow and is erected in place thereby.

* * * * *